US010968813B2

(12) United States Patent
Youn

(10) Patent No.: US 10,968,813 B2
(45) Date of Patent: Apr. 6, 2021

(54) HYBRID COOLING SYSTEM AND METHOD THEREOF

(71) Applicants: HYUNDAI MOTOR COMPANY, Seoul (KR); KIA MOTORS CORPORATION, Seoul (KR)

(72) Inventor: Kil Young Youn, Suwon-si (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 300 days.

(21) Appl. No.: 16/020,849

(22) Filed: Jun. 27, 2018

(65) Prior Publication Data

US 2018/0313253 A1 Nov. 1, 2018

Related U.S. Application Data

(62) Division of application No. 14/698,791, filed on Apr. 28, 2015, now abandoned.

(30) Foreign Application Priority Data

Nov. 26, 2014 (KR) ..... 10-2014-0166428

(51) Int. Cl.
*F01P 7/16* (2006.01)

(52) U.S. Cl.
CPC ..... *F01P 7/165* (2013.01); *F01P 2050/24* (2013.01)

(58) Field of Classification Search
CPC ..... F01P 7/165; F01P 2050/24; B60K 6/00; B60K 11/02; B60W 10/30; B60W 20/00
See application file for complete search history.

(56) References Cited

U.S. PATENT DOCUMENTS 5,372,098 A 12/1994 Borsboom et al.
6,575,258 B1 * 6/2003 Clemmer ..... B60L 50/66 180/68.5

(Continued)

FOREIGN PATENT DOCUMENTS

EP 1 637 709 A2 3/2006
JP H07-253020 A 10/1995

(Continued)

OTHER PUBLICATIONS

U.S. Non-Final Office Action dated Mar. 28, 2018 issued in U.S. Appl. No. 14/698,791.

(Continued)

*Primary Examiner* — Steve Clemmons
(74) *Attorney, Agent, or Firm* — Morgan, Lewis & Bockius LLP

(57) ABSTRACT

A hybrid cooling system of a vehicle includes a first cooling system having an engine, a first radiator, and a first water pump. A second cooling system includes a PE system, a second radiator, and a second water pump. A first cooling passage connects the engine and the PE system. A second cooling passage connects the first radiator and the second radiator. A third cooling passage and a fourth cooling passage connect the first cooling passage and the second cooling passage. Three-way valves is provided in the third cooling passage and the fourth cooling passage, respectively, to enable integrated cooling or individual cooling by opening and closing of the three-way valves.

17 Claims, 5 Drawing Sheets

(56) References Cited

U.S. PATENT DOCUMENTS

| | | | | |
|---|---|---|---|---|
| 8,875,820 | B2 | 11/2014 | Yamashita | |
| 9,649,909 | B2 | 5/2017 | Enomoto et al. | |
| 2004/0031452 | A1* | 2/2004 | Yamazaki | F02N 19/10 123/41.05 |
| 2012/0186775 | A1 | 7/2012 | Fraser | |
| 2012/0247753 | A1 | 10/2012 | Bachmann | |
| 2015/0275741 | A1* | 10/2015 | Amano | B60W 10/06 60/320 |
| 2016/0332505 | A1 | 11/2016 | Yamanaka et al. | |

FOREIGN PATENT DOCUMENTS

| | | | |
|---|---|---|---|
| JP | 2001-073765 | A | 3/2001 |
| JP | 2007-118809 | A | 5/2007 |
| JP | 2010-184633 | A | 8/2010 |
| JP | 2012-091547 | A | 5/2012 |
| JP | 2012-214104 | A | 11/2012 |
| KR | 10-2011-0134213 | A | 12/2011 |
| KR | 10-2012-0137655 | A | 12/2012 |
| KR | 10-2013-0019178 | A | 2/2013 |

OTHER PUBLICATIONS

U.S. Final Office Action dated Nov. 6, 2017 issued in U.S. Appl. No. 14/698,791.

U.S. Non-Final Office Action dated Jun. 9, 2017 issued in U.S. Appl. No. 14/698,791.

* cited by examiner

HYBRID COOLING SYSTEM AND METHOD THEREOF

CROSS-REFERENCE TO RELATED APPLICATION

This application is a divisional of U.S. patent application Ser. No. 14/698,791, filed on Apr. 28, 2015, which in turns claims the benefit of priority to Korean Patent Application No. 10-2014-0166428, filed on Nov. 26, 2014, the disclosures of which are incorporated herein in their entireties by reference.

TECHNICAL FIELD

The present disclosure relates to a hybrid cooling system and a method thereof, and more particularly, to a hybrid cooling system and a method thereof capable of using a cooling system for an engine and a cooling system for power electronics parts of a hybrid vehicle as in one unit or separately.

BACKGROUND

A hybrid vehicle has a cooling system for cooling power electronics (PE) parts and a separate cooling system for cooling an engine.

FIG. 1 shows a hybrid vehicle having a cooling system for an engine and a separate cooling system for PE parts.

However, the cooling system of the engine and the cooling system of the PE parts for the exiting hybrid vehicle do not communicate under an normal condition since an operating temperature of the cooling system for an engine and an operating temperature of the cooling system for PE parts are different. Thus in the normal case, an engine system is operated at 90° C. and an electronic system is operated at 40° C.

SUMMARY

The present disclosure has been made to solve the above-mentioned problems occurring in the prior art while advantages achieved by the prior art are maintained intact.

An aspect of the present inventive concept provides a hybrid cooling system and a method thereof capable of using a cooling system for an engine and a cooling system for electric power parts of a hybrid vehicle as in one unit or separately.

According to an exemplary embodiment of the present inventive concept, a hybrid cooling system of a vehicle includes a first cooling system including an engine, a first radiator, and a first water pump. A second cooling system includes a power electronics (PE) system, a second radiator, a second water pump. A first cooling passage connects the engine and the PE system. A second cooling passage connects the first radiator and the second radiator. A third cooling passage and a fourth cooling passage connect the first cooling passage and the second cooling passage. Three-way valves are provided in the third cooling passage and the fourth cooling passage, respectively, to enable integrated cooling or individual cooling by opening and closing of the three-way valves.

The first radiator may include a first water temperature sensor, and the second radiator may include a second water temperature sensor.

The 3-way valve may interlock to a hybrid control unit am.

When performing the integrated cooling, the 3-way valve may be opened to perform cooling along the engine, the first water pump, the first radiator, the second radiator, the second water pump, and the PE system which is connected to the engine.

When performing the individual cooling, the 3-way valve may be closed to drive the first cooling system and the second cooling system.

According to another exemplary embodiment of the present inventive concept, a hybrid cooling method of a vehicle includes determining whether outdoor temperature is lower than a temperature of a first water temperature sensor of the first cooling system for an engine. It is determined whether a current state is in an electric vehicle (EV) mode, if it is determined that the outdoor temperature is lower than the temperature of the first water temperature sensor. The 3-way valve is closed to perform individual cooling, if it is determined that the current state is in the EV mode. Whether or not a temperature of an engine coolant inside the engine is lower than a first high temperature determination temperature. Whether or not the engine is running is determined, if it is determined that the temperature of the engine coolant is lower than the first high temperature determination temperature. It is determined whether a state of charge (SOC) value of a battery is smaller than a threshold SOC value at which the EV mode is converted into a hybrid electric vehicle (HEV) mode when the engine is not running. The integrated cooling is performed, if it is determined that the SOC value is smaller than the threshold SOC value of the battery at which the EV mode is converted into the HEV mode.

The hybrid cooling method of a vehicle may further include operating only a second water pump of the second cooling system for a PE system during integrated cooling.

The step of determining whether the current state is in the EV mode may be performed by heating the engine coolant if it is determined that the SOC value is larger than the threshold SOC value of the battery at which the current state is converted from the EV mode into the HEV mode.

The hybrid cooling method of a vehicle may further include determining whether the outdoor temperature is lower than a temperature of a second water temperature sensor of a second cooling system for the PE system, if it is determined the outdoor temperature is higher than the temperature of the first water temperature sensor.

The step of performing the integrated cooling is performed, if it is determined that the temperature of the engine coolant is higher than the first high temperature determination temperature and if it is determined that the engine is running.

The hybrid cooling method may further include determining that the temperature of the engine coolant is lower than the first high temperature determination temperature, if it is determined that the outdoor temperature is lower than the temperature of the second water temperature sensor.

The step of determining whether the outdoor temperature is lower than the temperature of the second water temperature sensor may be performed, if is determined that the current state is not the EV mode but the HEV mode.

The hybrid cooling method may further include determining whether a temperature of a PE coolant is lower than a second high temperature determination temperature, if it is determined that the outdoor temperature is higher than the temperature of the second water temperature sensor.

The hybrid cooling method may further include determining whether the temperature of the engine coolant is lower than the first high temperature determination temperature, if it is determined that the temperature of the PE coolant is lower than the second high temperature determination temperature.

The step of performing the integrated cooling is performed, if it is determined i that the temperature of the engine coolant is lower than the first high temperature determination temperature.

The hybrid cooling method may further include performing the individual cooling, if it is determined that the temperature of the PE coolant is higher than the second high temperature determination temperature.

The step of performing the individual cooling may include determining whether the temperature of the engine coolant is higher than an ultra-high temperature determination temperature. Whether the temperature of the PE coolant is lower than the second high temperature determination temperature is determined, if it is determined that the temperature of the engine coolant is higher than the ultra-high temperature determination temperature. The integrated cooling is performed, if it is determined that the temperature of the PE coolant is lower than the second high temperature determination temperature. If it is determined that a duration of the integrated cooling exceeds a predetermined time by determining whether the duration of the integrated cooling exceeds the predetermined time when performing the integrated cooling, the step of performing the individual cooling is performed. If is determined that the duration of the integrated cooling does not exceed the predetermined time, the step of determining whether the temperature of the PE coolant is lower than the second high temperature determination temperature.

The step of performing the individual cooling may be performed, if it is determined that the temperature of the engine coolant is lower than the ultra-high temperature determination temperature, and the temperature of the PE coolant is higher than the second high temperature determination temperature.

The step of performing the individual cooling may be performed, if it is determined that the temperature of the engine coolant is higher than the first high temperature determination temperature.

BRIEF DESCRIPTION OF THE DRAWINGS

The above and other objects, features, and advantages of the present disclosure will be more apparent from the following detailed description taken in conjunction with the accompanying drawings.

DETAILED DESCRIPTION

Exemplary embodiments of the present disclosure will be described in detail with reference to the accompanying drawings.

Figure 1:
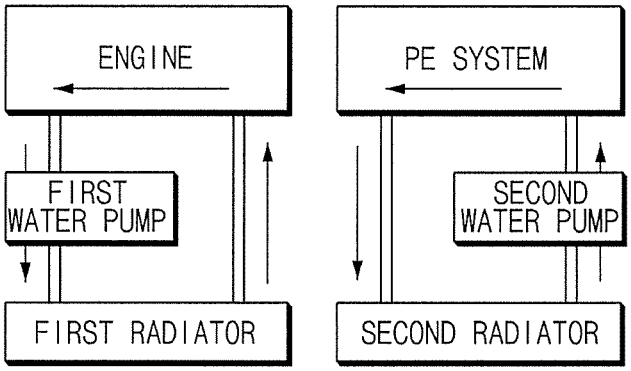
FIG. 1 is a diagram illustrating a hybrid cooling system according to the related art.
Figure 2:
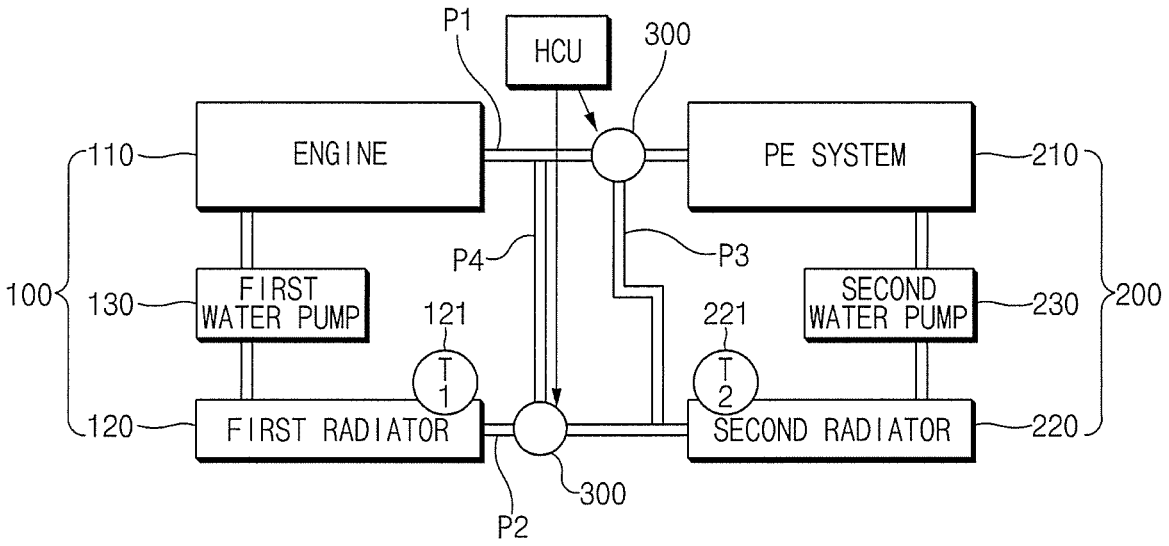
FIG. 2 is a diagram illustrating a hybrid cooling system according to an exemplary embodiment of the present inventive concept.
Figure 3:
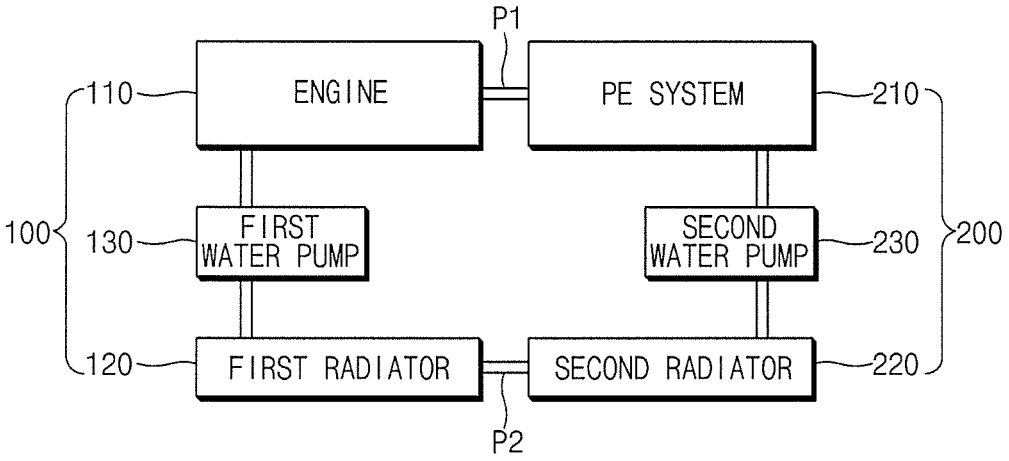
FIG. 3 is a diagram illustrating integrated cooling of a hybrid cooling system according to an exemplary embodiment of the present inventive concept.
Figure 4:
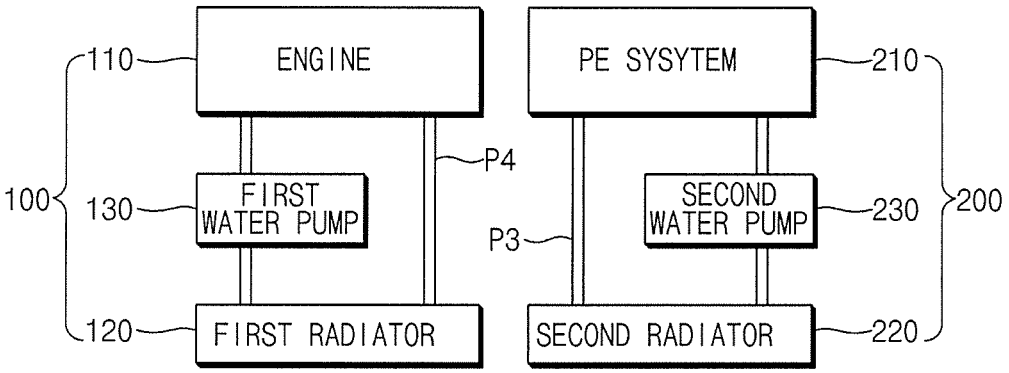
FIG. 4 is a diagram illustrating individual cooling of a hybrid cooling system according to an exemplary embodiment of the present inventive concept.

As illustrated in FIGS. 2 to 4, a hybrid cooling system according the present disclosure includes a first cooling system 100 for an engine 110, a second cooling system 200 for a power electronics (PE) system 210, a first cooling passage P1 connecting between the first cooling system 100 and the second cooling system 200, a second cooling passage P2, a third cooling passage P3, and three-way valves 300 provided in a fourth cooling passage P4 and the third cooling passage P3.

As illustrated in FIG. 2, the first cooling system 100 of a hybrid vehicle includes the engine 110, a first radiator 120, and a first water pump 130.

The second cooling system 200 of the hybrid vehicle includes the PE system 210, a second radiator 220, and a second water pump 230.

The first cooling system 100 and the second cooling system 200 according to the present disclosure have a plurality of cooling passages.

The first cooling passage P1 connects the engine 110 and the PE system 210, and the second cooling passage P2 connects the first radiator 120 and the second radiator 220.

Further, the first cooling passage P1 and the second cooling passage P2 are connected to the fourth cooling passage P4 for the first cooling system 100 and the third cooling passage P3 for the second cooling system 200.

Here, the three-way valve 300 is provided in the third cooling passage P3 and the fourth cooling passage P4 to open and close the third cooling passage P3 and the fourth cooling passage P4, thereby implementing integrated cooling and individual cooling.

That is, when the three-way valve 300, which is included in the third cooling passage P3 and the fourth cooling path P4, is open, the integrated cooling of the first cooling system 100 and the second cooling system 200 is performed. When the three-way valve 300 is closed, the individual cooling in which the first cooling system 100 and the second cooling system 200 are individually operated is performed.

In this case, as illustrated in FIG. 3, when performing the integrated cooling, the three-way valve 300 is open to perform cooling along the engine 110, the first water pump 130, the first radiator 120, the second radiator 220, the second water pump 230, and the PE system 210, in which the PE system 210 is connected to the engine 110.

Further, as illustrated in FIG. 4, when performing the individual cooling, the three-way valve 300 is closed to drive the first cooling system 100 and the second cooling system 200, separately.

In this case, the first radiator 120 may include a first water temperature sensor 121 and the second radiator 220 includes a second water temperature sensor 221 to perform the integrated cooling or the individual cooling depending on outside temperature (see FIG. 2).

The three-way valve 300 may interlock to a hybrid control unit (HCU).

As such, according to the present disclosure, each inlet and each outlet of the first cooling system 100 and the second cooling system 200 have the three-way valve 300 to enable operations of the integrated cooling, the individual cooling, a mixed cooling of the integrated cooling, and the individual cooling through the cooling passage.

In this case, since the HEV is operated in an initial electric vehicle (EV) mode and then in an hybrid electric vehicle (HEV) mode or in an engine mode at high speed, coolant is individually cooled and heated in the initial EV mode at low outdoor temperature, and then the integrated cooling is performed just before the engine 110 starts to increase a temperature of the engine 110 so as to increase the efficiency of the engine 110, and only the second water pump 230 is driven due to the integrated cooling to reduce load consumption. When the temperature of the coolant approaches a PE threshold temperature, the integrated cooling is converted into the individual cooling. When a temperature of engine coolant excessively rises, the individual cooling is converted into the integrated cooling to reduce the temperature of the engine 110.

The individual cooling is converted into the integrated cooling at room temperature just before the engine 110 starts to increase the temperature so as to increase the efficiency of the engine 110, and only the second water pump 230 is driven due to the integrated cooling to reduce load consumption. When the temperature of coolant approaches the PE threshold temperature, the integrated cooling is converted into the individual cooling. When the temperature of the engine coolant excessively rises, the individual cooling is converted into the integrated cooling to reduce the temperature of the engine 110.

Further, at the time of high temperature, when the temperature of coolant approaches the PE threshold temperature, the integrated cooling is converted into the individual cooling, and when the temperature of the engine coolant excessively rises, the individual cooling is converted into the integrated cooling to reduce the temperature of the engine.

Figure 5:
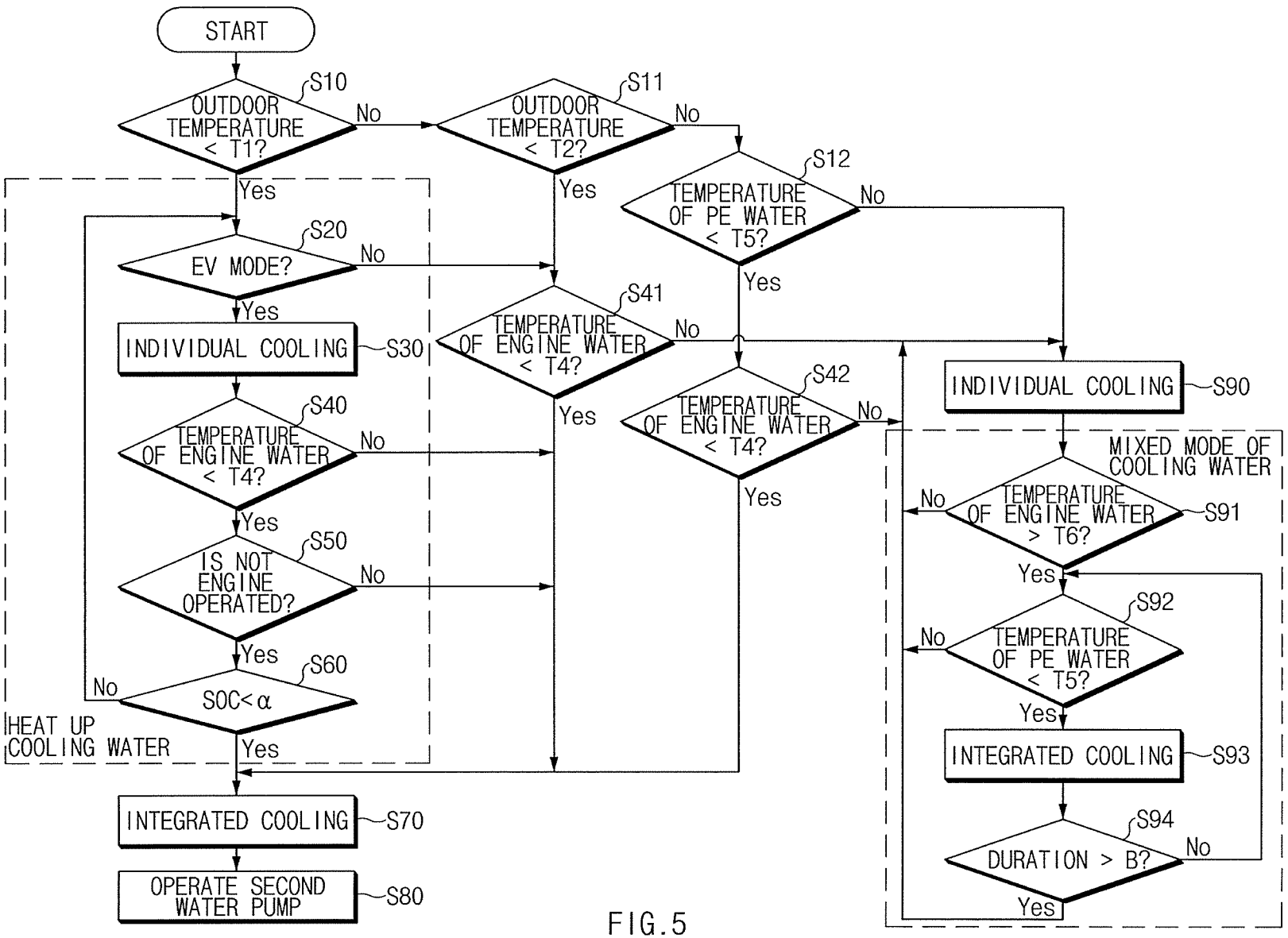
FIG. 5 is a flow chart illustrating a hybrid cooling method according to an exemplary embodiment of the present inventive concept.

As illustrated in FIG. 5, a hybrid cooling method according to the present disclosure includes comparing outdoor temperature with a temperature of the engine (S10), determining whether a current state is in the EV mode (S20), performing the individual cooling (S30), determining a temperature of engine water (S40), determining whether the engine is running (S50), determining a state of charge (SOC) value (S60), and determining the integrated cooling (S70).

In step S10, it is determined whether the outdoor temperature is lower than a temperature of the first water temperature sensor 121 of the first cooling system 100 for the engine.

In step S20, if the outdoor temperature is lower than the temperature of the first water temperature sensor 121, it is determined whether the current state is in the EV mode since the outdoor temperature is in a low temperature state.

In step S30, if the current state is the EV mode, the three-way valve 300 is closed to perform the individual cooling in which the first cooling system 100 for the engine and the second cooling system 200 for the PE system 210 are operated.

In step S40, it is determined whether the temperature of the engine water is lower than a high temperature determination temperature of coolant of the engine based on a determination result of step S30.

In step S50, if the temperature of the engine water is lower than the high temperature determination temperature of the engine coolant, it is determined that the engine is running.

In step S60, if the engine is not running, it is determined whether a state of charge (SOC) value of a battery is smaller than a threshold SOC value at which the EV mode is converted into the HEV mode.

If the SOC value is larger than the threshold SOC value of the battery at which the current state is converted from the EV mode into the HEV mode, the engine coolant is heated and thus the process may return to the second step S20.

In step S70, if the SOC value is smaller than the threshold SOC value at which the current state is converted from the EV mode into the HEV mode, the three-way valve 300 is opened to perform the integrated cooling in which the first cooling system 100 and the second cooling system 200 are integrally operated.

In step S80, only the second water pump 230 of the second cooling system 200 for the PE system 210 is operated when performing the integrated cooling in step S70.

If it is determined in step S10 that the outdoor temperature is higher than the temperature of the first water temperature sensor 121, since the outdoor temperature is in the normal temperature state, the hybrid cooling method includes step S11 in which it is determined that the outdoor temperature is lower than the temperature of the second water temperature sensor 221 which is formed in the second cooling system 200 for the PE system 210.

In this case, if the outdoor temperature is lower than the temperature of the second water temperature sensor 221, the hybrid cooling method may include step S41 in which it is determined whether the temperature of the engine water is lower than the high temperature determination temperature of the engine coolant.

If it is determined in step S40 that the temperature of the engine water is higher than the high temperature determination temperature of the engine coolant or if it is determined in step S50 that the engine is operated, step S70 is performed for the integrated cooling.

If it is determined that the current state is not the EV mode but the HEV mode when determining the EV mode, step S41 is performed.

Further, if it is determined that the outdoor temperature is higher than the temperature of the second water temperature sensor 221, the hybrid cooling method includes step S12 in which whether the temperature of the PE water is lower than the high temperature determination temperature of the PE coolant is determined since the outdoor temperature is in a high temperature state.

If it is determined that the temperature of the PE water is lower than the high temperature determination temperature of the PE coolant, the hybrid control method may include step S42 in which it is determined whether the temperature of the engine water is lower than the high temperature determination temperature of the engine coolant.

If it is determined in steps S41 and S42 that the temperature of the engine water is lower than the high temperature determination temperature of the engine coolant, step S70 is preformed for the integrated cooling.

Further, if it is determined that the temperature of the PE water is higher than the high temperature determination temperature of the PE coolant, the hybrid cooling method includes step S90 of performing the individual cooling.

The individual cooling of step S90 includes step S91 in which it is determined whether the temperature of the engine water is higher than an ultra-high temperature determination temperature of the engine coolant. If it is determined that the temperature of the engine water is higher than the ultra-high temperature determination temperature of the engine coolant, it is determined whether the temperature of the PE water is lower than the high temperature determination temperature of the PE coolant in step S92. If it is determined that the temperature of the PE water is lower than the high temperature determination temperature of the PE coolant, it is determined whether the integrated cooling is performed in step S93. In step S94, it is determined whether a duration of the integrated cooling exceeds a predetermined time by determining whether the duration of the integrated cooling exceeds the predetermined time when carrying out the integrated cooling. The ninetieth step S90 is performed if it is determined that the duration of the integrated cooling exceeds the predetermined time. If it is determined that the duration of the integrated cooling does not exceed the predetermined time, step S92 is performed for a mixed mode of the engine and PE coolant.

In this case, if it is determined that the temperature of the engine water is lower than an ultra-high temperature determination temperature of the engine coolant, and if it is determined that the temperature of the PE water is higher than the high temperature determination temperature of the PE coolant, step S90 is performed for the individual cooling.

Further, if it is determined that the temperature of the engine water is higher than the high temperature determination temperature of the engine coolant, step S90 is performed for the integrated cooling.

As described above, according to the exemplary embodiments of the present inventive concept, it is possible to improve the fuel efficiency by supplying the heated coolant to the cooling system for an engine at low temperature, improve performance and durability of the engine by shortening the warning-up time while maintaining performance and efficiency of the cooling system for power electronics parts, save energy by allowing one water pump to perform the integrating cooling at low temperature and room temperature, increase the cooling performance by integrally using the radiator, and improve the efficiency by improving the engine cooling performance due to the composite cooling at high temperature.

As described above, although the present disclosure has been described with reference to exemplary embodiments and the accompanying drawings, it would be appreciated by those skilled in the art that the present disclosure is not limited thereto but various modifications and alterations might be made without departing from the scope defined in the following claims.

What is claimed is:

1. A hybrid cooling method of a vehicle, comprising steps of:

determining whether a current state is in an electric vehicle (EV) mode;

performing individual cooling if it is determined that the current state is in the EV mode;

determining whether a temperature of an engine coolant inside an engine is lower than a first high temperature determination temperature;

determining whether the engine is running, if it is determined that the temperature of the engine coolant inside the engine is lower than the first high temperature determination temperature; and performing integrated cooling based on a state of charge (SOC) value of a battery.

2. The hybrid cooling method according to claim 1, further comprising steps of:

determining whether the SOC value is smaller than a threshold SOC value at which the EV mode is converted into a hybrid electric vehicle (HEV) mode when the engine is not running; and performing integrated cooling, if it is determined that the SOC value is smaller than the threshold SOC value at which the EV mode is converted into the HEV mode.

3. The hybrid cooling method according to claim 1, further comprising a step of:

operating only a water pump of a second cooling system for a PE system when performing the step of performing the integrated cooling.

4. The hybrid cooling method according to claim 1, wherein step of determining whether the current state is in the EV mode is performed by heating the engine coolant inside the engine if it is determined that the SOC value is larger than the threshold SOC value at which the current state is converted from the EV mode into the HEV mode.

5. The hybrid cooling method according to claim 1, wherein the step performing the integrated cooling is performed, if it is determined that the temperature of the engine coolant inside the engine is higher than the first high temperature determination temperature or if it is determined that the engine is running.

6. The hybrid cooling method according to claim 1, further comprising steps of:

determining whether outdoor temperature is lower than a temperature of a first water temperature sensor of a first cooling system for a engine;

determining whether the outdoor temperature is lower than a temperature of a second water temperature sensor of a second cooling system for a PE system, if it is determined the outdoor temperature is higher than the temperature of the first water temperature sensor.

7. The hybrid cooling method according to claim 6, further comprising a step of:

determining whether the temperature of the engine coolant inside the engine is lower than the first high temperature determination temperature, if it is determined that the outdoor temperature is lower than the temperature of the second water temperature sensor.

8. The hybrid control method of claim 7, wherein the step of performing the integrated cooling is performed, if it is determined that the temperature of the engine coolant inside the engine is lower than the first high temperature determination temperature.

9. The hybrid cooling method according to claim 8, wherein the step of performing the individual cooling is performed if it is determined that the temperature of the engine coolant inside the engine is higher than the first high temperature determination temperature.

10. The hybrid cooling method according to claim 6, wherein the step of determining whether the outdoor temperature is lower than the temperature of the second water temperature sensor is performed, if it is determined that the current state is not the EV mode but the HEV mode.

11. The hybrid cooling method according to claim 6, further comprising a step of:

determining whether the temperature of a PE coolant inside the PE system is lower than a second high temperature determination temperature, if it is determined that the outdoor temperature is higher than the temperature of the second water temperature sensor.

12. The hybrid cooling method according to claim 11, further comprising a step of:

determining whether the temperature of the engine coolant inside the engine is lower than the first high temperature determination temperature, if it is determined that the temperature of the PE coolant inside the PE system is lower than the second high temperature determination temperature.

13. The hybrid control method of claim 12, wherein the step of performing the integrated cooling is performed, if it is determined that the temperature of the engine coolant inside the engine is lower than the first high temperature determination temperature.

14. The hybrid cooling method according to claim 11, further comprising a step of:

performing the individual cooling, if it is determined that the temperature of the PE coolant inside the PE system is higher than the second high temperature determination temperature.

15. The hybrid cooling method according to claim 14, wherein the step of performing the individual cooling includes steps of:

determining whether the temperature of the engine coolant inside the engine is higher than an ultra-high temperature determination temperature;

determining whether the temperature of the PE coolant inside the PE system is lower than the second high temperature determination temperature, if it is determined that the temperature of the engine coolant inside the engine is higher than the ultra-high temperature determination temperature;

performing the integrated cooling, if it is determined that the temperature of the PE coolant inside the PE system is lower than the second high temperature determination temperature; and determining whether a duration of the integrated cooling exceeds a predetermined time when performing the integrated cooling, wherein the step of performing the individual cooling is performed if the duration exceeds the predetermined time, and the step of determining whether the temperature of the PE water is lower than the second high temperature determination temperature is performed if the duration of the integrated cooling does not exceed the predetermined time.

16. The hybrid cooling method according to claim 15, wherein the step of performing the individual cooling is performed, if it is determined that the temperature of the engine coolant inside the engine is lower than the ultra-high temperature determination temperature or the temperature of the PE coolant inside the PE system is higher than the second high temperature determination temperature.

17. A hybrid cooling system of a vehicle, comprising:

a first cooling system including an engine, a first radiator, and a first water pump directly connecting the engine and the first radiator;

a second cooling system including a power electronics (PE) system, a second radiator, a second water pump;

a first cooling passage connecting the engine and the PE system;

a second cooling passage connecting the first radiator and the second radiator;

a third cooling passage and a fourth cooling passage each connecting the first cooling passage and the second cooling passage;

three-way valves provided in the third cooling passage and the fourth cooling passage, respectively, to enable integrated cooling or individual cooling by opening and closing of the three-way valves; and a controller configured to:

determine whether a current state is in an electric vehicle (EV) mode;

control to perform individual cooling if it is determined that the current state is in the EV mode;

determine whether a temperature of an engine coolant inside an engine is lower than a first high temperature determination temperature;

determine whether the engine is running, if it is determined that the temperature of the engine coolant inside the engine is lower than the first high temperature determination temperature; and performing integrated cooling based on a state of charge (SOC) value of a battery.

* * * * *